US009303408B1

(12) United States Patent
Hunter

(10) Patent No.: US 9,303,408 B1
(45) Date of Patent: Apr. 5, 2016

(54) MULTI-PITCH GABLE PEDIMENT

(71) Applicant: Al Hunter, Raleigh, NC (US)

(72) Inventor: Al Hunter, Raleigh, NC (US)

( * ) Notice: Subject to any disclaimer, the term of this patent is extended or adjusted under 35 U.S.C. 154(b) by 0 days.

(21) Appl. No.: 13/928,808

(22) Filed: Jun. 27, 2013

(51) Int. Cl.
*E04D 13/00* (2006.01)
*E04D 13/15* (2006.01)
*E04D 13/147* (2006.01)

(52) U.S. Cl.
CPC ..... *E04D 13/15* (2013.01); *E04D 13/147* (2013.01)

(58) Field of Classification Search
CPC ..... E04D 2001/302; E04C 2003/0439; E04C 2/20; E04B 2001/2439; E04B 1/34315
USPC ..... 52/57, 94, 90.1, 98, 100, 105, 749.1, 52/749.12, DIG. 1; 33/415–417, 429, 482, 33/562–563, 566
See application file for complete search history.

(56) References Cited

U.S. PATENT DOCUMENTS

| | | | | |
|---|---|---|---|---|
| 614,144 | A | 11/1898 | Thompson | |
| 2,154,395 | A * | 4/1939 | Clark | 40/576 |
| 2,809,434 | A | 10/1957 | Cordier | |
| 3,010,209 | A * | 11/1961 | McKinley | 33/481 |
| 3,163,101 | A | 12/1964 | Caparrelli | |
| 3,797,181 | A | 3/1974 | Nievelt | |
| D303,705 | S | 9/1989 | Benefield | |
| 4,924,644 | A * | 5/1990 | Lewis | 52/105 |
| 5,245,804 | A | 9/1993 | Schiedegger et al. | |
| D357,326 | S | 4/1995 | Poole | |
| 5,537,786 | A * | 7/1996 | Lozier et al. | 52/23 |
| 5,673,526 | A * | 10/1997 | Schiedegger et al. | 52/473 |
| D418,232 | S | 12/1999 | Carranza | |
| 6,422,936 | B1 | 7/2002 | Van Gilst et al. | |
| 7,430,833 | B2 * | 10/2008 | Pulte | 52/57 |
| 8,381,459 | B2 | 2/2013 | Ramsay et al. | |
| 2006/0211356 | A1 | 9/2006 | Grassman | |
| 2012/0000146 | A1 * | 1/2012 | Yaggi et al. | 52/90.2 |

* cited by examiner

*Primary Examiner* — Brian Glessner
*Assistant Examiner* — Paola Agudelo
(74) *Attorney, Agent, or Firm* — Middleton Reutlinger

(57) ABSTRACT

A multi-pitch gable pediment integrally molded for depending from a gable-type roof. The multi-pitch gable pediment may include one or more incremental markings. At least one incremental marking illustrates a pitch angle. The incremental marking may be used to separate a portion of the integrally molded multi-pitch gable pediment from a remaining portion to contour to a predetermined pitch angle of a roof.

9 Claims, 2 Drawing Sheets

MULTI-PITCH GABLE PEDIMENT

BACKGROUND OF THE INVENTION

1. Field of the Invention

The present invention relates to a gable pediment and particularly to a multi-pitch gable pediment for use with a variety of pitch angles of a building's roof.

2. Description of Related Art

Various gable pediments have been proposed in the art for buildings. More commonly, the gable pediment is custom fabricated for a particular pitch of a roof.

There are several disadvantages associated with custom fabricating the gable pediment either on or off of the building site. Multiple measurements, cuts, and assembly of multiple members may be required. This may result in undesirable additional cost of materials, labor, and time to fabricate and install.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
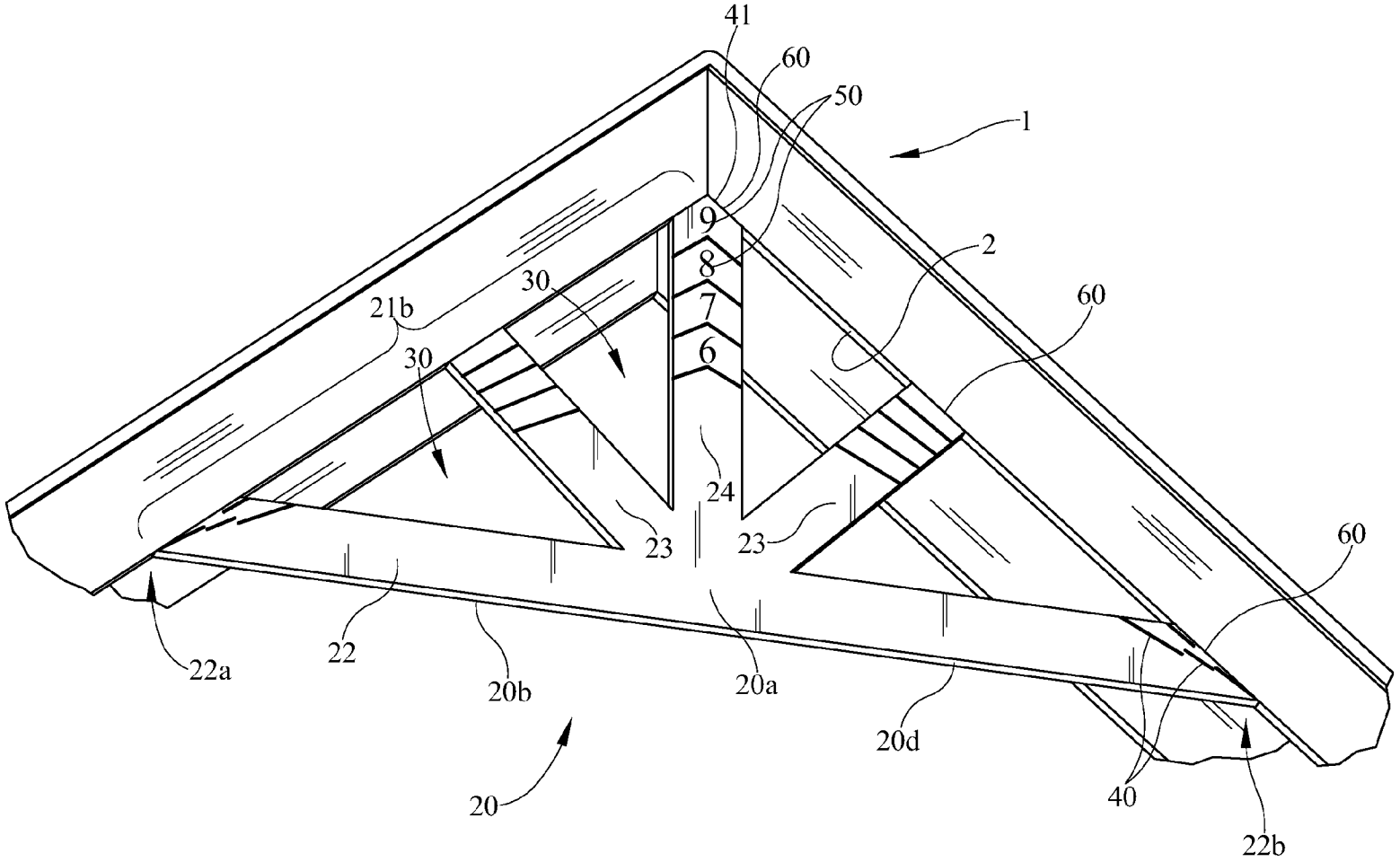
FIG. 1 is a bottom perspective view of a multi-pitch gable pediment according to one embodiment depending from the bottom of the roof, with portions of the building broken away, illustrating the severable upper portion of the pediment previously separated along an incremental marking representing pitch angle 10.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative embodiments are possible.

As shown in FIG. 1, a building roof 1 contains an eave 2 that includes at least one embodiment of a depending multi-pitch gable pediment 20. Applications of the pediment 20 may or may not be load bearing. Such descriptions of possible applications are not considered to be limiting. Pediment 20 is integrally formed and may include one or more projecting or interconnected members such as, but not limited to, a lower horizontal member 22, two or more angled middle members 23, and a vertical upper member 24. Gaps or openings 30 may be positioned between or define adjacent members. Pediment

20 includes a front side 20*a* and an opposing back side 20*b* interconnected by opposing lateral sides 20*c* and a bottom side 20*d*. Pediment 20 includes one or more incremental markings 40 on one or more surfaces or sides. Incremental markings 40 represent one or more pitch angles of the roof 1. Incremental markings 40 allow the user to modify the pediment 20 to the predetermined pitch angle of a desired application or building's roof. The one or more incremental markings 40 identify lines of demarcation associated with the predetermined pitch angle for the user to separate a severable upper portion 21*a* from a remaining lower portion 21*b*. Upon separation of the upper portion 21*a* and installation of the lower portion 21*b*, the lower portion 21*b* contours to and depends from the roof 1 at the predetermined pitch angle. Although the pediment 20 is shown in detail in the drawings, it is merely representative of one embodiment, and it is to be understood that there are a variety of shapes, sizes, orientations, constructions, and quantities which may be used and still be within the scope of the teachings herein. For example, one or more members may project at various angles. Further, spaces 30 between the members may not be triangular in shape. Also, the lateral sides 20*c* may be of a variety of shapes, sizes, construction, that result in varying contacting surfaces with the roof at respective incremental markings 40.

Figure 2:
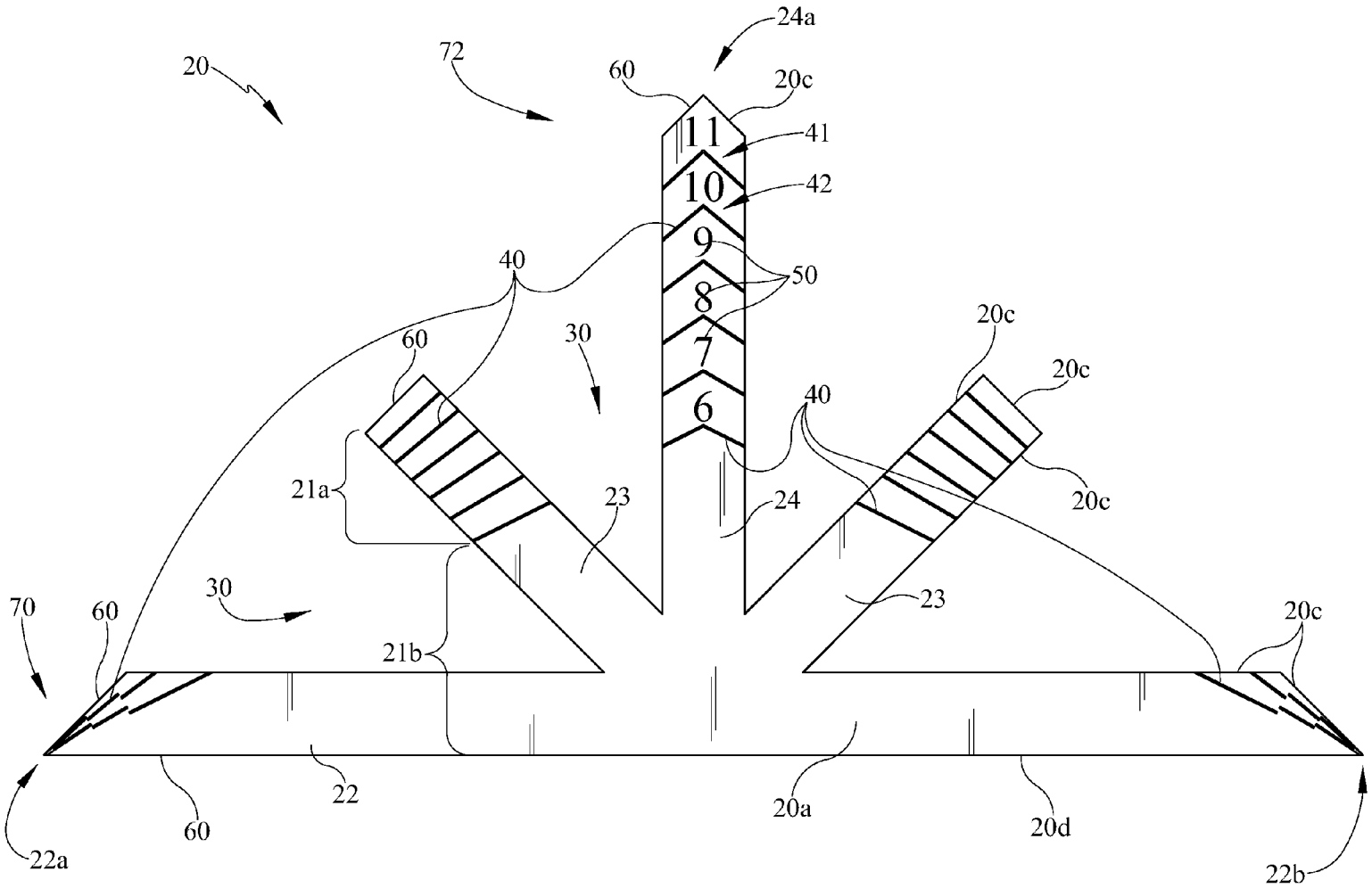
FIG. 2 is a side view of the gable pediment of FIG. 1 illustrating one embodiment as formed.

As depicted in FIGS. 1 and 2, pediment 20 is of a unitary construction and is integrally formed by standard injection molding techniques known in the art of a PVC or similar material. However, the choice of manufacture is not deemed to be limiting. Pediment 20 is made of one or more numerous materials commonly known in the art depending on specific product and environmental conditions. Alternatively stated, materials may be readily available for use in the construction industry. Some common examples of materials include, but are not limited to, fiberglass, fiber-reinforced plastic, polypropylene, polyurethane, and urethane. The choice of materials described herein is not deemed to be limiting. Manufacturing the integrally molded pediment may include pouring or injecting one or more materials into the mold cavities. The mold cavities may also integrally form the incremental markings 40 therein. However, it is understood that the incremental markings 40 may be added subsequently in another step or by another method such as, but not limited to, adding labeling or scoring to the pediment 20. Further, flashing or other excess materials may be removed from the pediment 20 upon removal from the mold cavities. A primer coating and/or paint may be applied to the pediment as well.

As shown in FIG. 1, the severable upper portion 21*a* of the "as formed" pediment 20 (FIG. 2) may be removed along one of the incremental markings 40 and the lower portion 21*b* may be directly installed to a desired roof pitch angle. Pediment 20 includes the lower portion 21*b* and the severable upper portion 21*a*, each dependent on the selected incremental marking 40 associated with the line of demarcation at the desired pitch angle. An outer peripheral edge or an outer edge 60 runs along the lateral sides 20*c* and the bottom side 20*d*. The incremental markings 40 may extend along one or more of the opposing upper sides of the pediment outer peripheral edge, in doing so the outer peripheral edge 60 or upper sides may change to a second configuration due to separation along a chosen incremental marking. More specifically, the outer peripheral edge 60 adjacent a lower distal end 70 or lower member 22 of the pediment 20 may include two opposing lower ends 22*a*, 22*b* straddling an apex 24*a* at an upper proximal end 72 or upper member 24 of the pediment 20. As a result of the incremental marking, each opposing upper side of the lower portion 21*b* includes the pitch angle between its respective opposing lower end 22*a*, 22*b* and apex 24*a*. In application, pediment apex 24*a* merges with two adjacent roof lines and continues downwardly to the two opposing lower ends 22*a*, 22*b*, respectively. For example, a first incremental marking 40 representing a first pitch angle such as, but not limited to, pitch angle 11, may extend from at least one of the two opposing lower ends 22*a* and 22*b* and continue upwardly to a first apex 41. The first incremental marking 40 may include or indicate removal of one or more upper sides of the pediment outer peripheral edge 60 and is shown as extending from each of the opposing lower ends and merging at the first apex 41. A second incremental marking 40 representing a second pitch angle, such as, but not limited to pitch angle 10, is spaced interiorly from the first incremental marking to represent a second or additional pitch angle. Second incremental marking extends from each of the two opposing lower ends 22*a* and 22*b* and extends upwardly to a second apex 42, with the second apex being a different location from the first apex. As such two or more incremental markings 40 may be spaced from each other to identify one or more pitch angles on pediment 20. It is shown in the figures that the spaced incremental markings include, but is not limited to, pitch angles of 8-11. For example, an additional incremental marking illustrating a pitch angle of 12 may be used. As further shown in FIG. 2, outer peripheral edge 60 of pediment 20 may include a predetermined pitch angle of 12, when unitarily formed. However it is understood that the outer peripheral edge 60 of the pediment may not coincide with a predetermined pitch angle when molded. In that instance, the un-angled outer peripheral edge would be separated with the severable upper portion 21*a* at one of the predetermined incremental markings 40.

Although incremental markings 40 are shown in detail in the drawings, it is merely representative of one embodiment, and it is to be understood that there are a variety of shapes, sizes, orientations, constructions, and quantities which may be used and still be within the scope of the teachings herein. For example, the incremental markings 40 may be weakened or scored to facilitate separation along the line of demarcation. Another example, the incremental markings 40 are shown as V-shaped grooves, however it is understood a line protrusion or structure protruding from the front side 20*a* may be used. Further, the incremental markings 40 need not be a continuous line across a single member as shown in the middle member 23. For example, the lines representing the incremental markings 40 on the lower member 22 are discontinuous or segmented (i.e. dashed) while still enabling the user to identify the appropriate incremental marking 40. Although not shown, other markings or patterns not related to the pitch angle may be present in the unitary pediment to enable the user to consistently remove one or more portions to create a variety of ornamental appearances for a desired application.

A differentiation between two or more incremental markings 40 may assist the user in selecting and separating the severable upper portion 21*a* from the lower portion 21*b* along the predetermined incremental marking 40 associated with the desired pitch angle. Differentiation may be advantageous because incremental markings 40 may cross one or more members 22, 23, and 24 along its length and is thus interrupted by spaces 30. Further, the incremental markings 40 may be closer in lateral proximity to each other at the opposing lower ends 22*a* and 22*b* adjacent the pediment lower distal end 70 as opposed to the apex 24*a*. As such, in addition to the markings being in different locations, the incremental markings 40 representing separate pitch angles may be dissimilar in construction relative to each other. By differing in construction, the desired incremental marking 40 may be correctly identified by the user to apply the separation along the length of the incremental marking associated with the predetermined pitch angle. For example as shown at lower end 22*b* of lower member 22 in FIGS. 1 and 2, adjacent incremental markings 40 may be longitudinally offset from the other or linearly discontinuous to enable differentiation therebetween by the user. Further, other examples of varying the incremental markings may include, but is not limited to, differentiation by color, shapes, quantities, location, and size. For example, although the incremental markings 40 are illustrated in the drawings on the front side 20*a*, it should be understood that the incremental markings 40 may be on one or more sides or surfaces of the pediment 20 to differentiate therebetween. For instance, the even numbered incremental markings may be on the front side 20*a* and the odd numbered incremental markings may be on the back side 20*b*. Further as shown in exaggeration, a numerical number or identification 50 may be used adjacent the incremental marking 40 to identify the correspondence pitch angle. In addition, instructions or a key may aid in identification of the incremental markings corresponding to a pitch angle.

In use for installing the pediment 20 embodiment, the user determines the pitch angle required for the depending pediment. The user correspondingly identifies the incremental marking 40 on the pediment 20 associated with the desired pitch angle. If the pitch angle is determined to correlate to the pediment outer peripheral edge pitch angle as formed, pitch angle 12 as shown, the user attaches the depending pediment as is to the eaves 2 of the roof 1. However, if the pitch angle is other than the formed angled outer peripheral edge 60, the user will separate the severable upper portion 21*a* from the pediment lower portion 21*b* along the predetermined incremental marking 40 thereby creating a line of demarcation. The separation of the superfluous material or upper portion 21*a* to generate the desired pitch angle of the lower portion 21*b* may be obtained by, but is not limited to, cutting, breaking, or combinations thereof. With the outer peripheral edge of the pediment lower portion 21*b* contoured with and thus parallel with the roof pitch angle, the pediment lower portion 21*b* is positioned against the bottom or eave 2 of the roof gable and secured. A variety of attachments such as, but not limited to, nails, screws, brackets, and adhesive may be used to secure the lower portion 21*b* to the roof. Further cosmetic steps such as filling attachment holes or painting the pediment 20 may occur. It should also be understood that the user may or may not alter the remaining incremental markings 40 of the lower portion 21*b*. For instance, if grooves are used to identify the markings, the remaining incremental markings of the lower portion 21*b* may be filled with a material to create a planar front side 20*a*. Further, if protrusions are used to identify the incremental markings, they may be sanded or broken off to create a planar front side 20*a*. Although not shown, the front side 20*a* with the incremental markings 40 may be installed facing inwardly towards the housing with the back side 20*b* facing outwardly to conceal the markings.

It is understood that while certain embodiments of the invention have been illustrated and described, it is not limited thereto except insofar as such limitations are included in the following claims and allowable functional equivalents thereof.

I claim:

1. A multi-pitch gable pediment comprising:

an integrally molded gable pediment having a substantially horizontal first member interconnected to at least one second member extending upwardly from said horizontal member, each one of said first member and said at least one second member includes an outer peripheral edge defining an external perimeter of said gable pediment;

wherein said gable pediment includes one or more incremental markings thereon, wherein at least one said incremental marking extends across each of said first member and said second member, wherein said one or more incremental markings represents a predetermined roof pitch angle; and wherein said outer peripheral edge of said first member is spaced away from said outer peripheral edge of said at least one second member by at least one gap within said external perimeter of said gable pediment, and said outer peripheral edge of each one of said first member and said at least one second member is angled relative to the horizontal plane at an additional predetermined roof pitch angle that is a different angle from said predetermined roof pitch angle represented by said one or more incremental markings, and wherein said one or more incremental markings is positioned interiorly of said external perimeter and represents a severable upper portion from a remaining lower portion of said gable pediment.

2. The multi-pitch gable pediment of claim 1 wherein said gable pediment includes two opposing lower ends and an apex therebetween, wherein said one or more incremental markings extend upwardly from each of said lower ends towards said apex.

3. The multi-pitch gable pediment of claim 1 further comprising one or more openings extending from a front side to a back side of said pediment, wherein said one or more incremental markings are interrupted across said at least one of said front side and said back side of said pediment by said openings.

4. The multi-pitch gable pediment of claim 1 wherein at least two of said incremental markings are dissimilar in construction.

5. The multi-pitch gable pediment of claim 4 wherein said one or more incremental markings are a discontinuous line.

6. A multi-pitch gable pediment comprising:

a front side and an opposing back side, wherein said front side and said back side of said gable pediment define a plurality of interconnected members with an outer peripheral edge between said front side and said back side, wherein said outer peripheral edge includes a first apex with laterally depending sides extending to two opposing lower ends to represent a first roof pitch angle;

at least one of said front side or said back side includes one or more incremental markings, such that two of said incremental markings define a second apex on said front side or back side, wherein said second apex represents a second roof pitch angle, and said at least one of said one or more incremental markings is spaced interiorly from said first apex such that said second apex is located below said first apex and said laterally depending sides representing said first roof pitch angle whereby said first roof pitch angle represents a different angle from said second roof pitch angle; and wherein said at least one of said one or more incremental markings represents a severable upper portion from a remaining lower portion of said gable pediment.

7. The multi-pitch gable pediment of claim 6 wherein said front side includes one or more surfaces of said plurality of interconnected members and said back side includes one or more surfaces of said plurality of interconnected members.

8. The multi-pitch gable pediment of claim 7 wherein one of said plurality of said interconnected members is spaced from another one of said plurality of said interconnected members by one or more spaces.

9. The multi-pitch gable pediment of claim 8 wherein said one or more incremental markings is interrupted by said one or more spaces.

* * * * *